United States Patent [19]

Rifkin

[11] 4,014,070

[45] Mar. 29, 1977

[54] PANEL ATTACHED GUIDES FOR TUB ENCLOSURES AND THE LIKE

[75] Inventor: Morton S. Rifkin, Hialeah, Fla.

[73] Assignee: Diston Industries, Inc., Hialeah, Fla.

[22] Filed: Aug. 25, 1975

[21] Appl. No.: 607,475

[52] U.S. Cl. ..... 16/90; 49/410; 16/96 R

[51] Int. Cl.[2] ..... E05D 13/02

[58] Field of Search ..... 16/87 R, 87 B, 90, 91, 16/93 R, 94 R, 96 R; 160/44; 49/405, 407, 408, 409, 410, 411, 413, 504

[56] References Cited

UNITED STATES PATENTS

| | | | |
|---|---|---|---|
| 3,052,930 | 9/1962 | Mathews | 16/93 R X |
| 3,384,998 | 5/1968 | Abramson | 49/411 |
| 3,653,157 | 4/1972 | Casebolt | 16/93 R X |

FOREIGN PATENTS OR APPLICATIONS

| | | | |
|---|---|---|---|
| 747,630 | 4/1933 | France | 49/411 |

OTHER PUBLICATIONS

"Sliding Steel Sash," The Architectural Forum, p. 210, Mar. 1939.

*Primary Examiner*—Werner H. Schroeder
*Assistant Examiner*—Moshe I. Cohen
*Attorney, Agent, or Firm*—Salvatore G. Militana

[57] ABSTRACT

Panel attached guides for tub enclosures and the like having an inclined and unobstructed combined water return and track for sliding panels, the guides having a slotted portion for receiving the lower edge portion of a panel with fastening means for securing the guides to the panel and a second slotted portion for slidably receiving a ledge on the track to permit the sliding movement of the panels in side by side relation. The guides mounted on the panel that is further removed from the ledge than the other panel being provided with a web portion joining the slotted portion of such a width to permit the other panel to slide along the track without obstructing the sliding movement of the further removed panel.

4 Claims, 7 Drawing Figures

PANEL ATTACHED GUIDES FOR TUB ENCLOSURES AND THE LIKE

BACKGROUND OF THE INVENTION

1. Field Of The Invention

This invention relates to guides for sliding panels and is more particularly directed to panel attached guides for tub enclosures and the like.

2. Description Of The Prior Art

Panel guides for tub and shower enclosures must provide a track for the panels and the drainage of water back into the tub or shower that impinges on and flows down the panels and into the panel guides. In order that the water not collect in the tracks or guides, the conventional panel tracks that consist of a pair of slots for the panels to slide along provide weep holes to permit water that collects in the tracks to drain back into the tub. However, dirt, grime and the like accumulate in the tracks and blocks off the weep holes so that the tracks being difficult to keep clean will have water collected therein.

To avoid this situation, the applicant obtained U.S. Pat. No. 3,350,739 which provides for a plurality of molded guides mounted in an L-shaped track members, the panels being slidably mounted in the guides. This system of guides prevented water from accumulating in the track members, but fails to prevent the collection of grime and dirt about the guide members.

The housewife still found it difficult to clean the track in the vicinity of the guide members. Consequently, it is contemplated by the present invention to avoid the above objections by providing guide members attached to the panels and slidably positioned on L-shaped tracks.

Brief Summary Of The Invention

Therefore, a principal object of the present invention is to provide tub and shower enclosures with a track having an L-shape and an inclined and completely unobstructed surface for the drainage of water back to the enclosure and guide members attached to panels for sliding along the track.

Another object of the present invention is to provide panel guide members for tub and shower enclosures that fasten to the panels and slide along a track that is mounted on the tub, etc. whereby the panels are able to slide along each other.

A further object of the present invention is to provide panel guide members for tub and shower enclosures that slide along a track which does not permit the accumulation of water, dirt or grime and is readily maintained in a clean condition.

A still further object of the present invention is to provide tub and shower enclosures with panel guides which are simple in construction and readily fastened in position on the panels by means of locking pins molded integrally with the panel guides.

With these and other objects in view, the invention will be best understood from a consideration of the following detailed description taken in connection with the accompanying drawing forming a part of this specification, with the understanding, however, that the invention is not confined to any strict conformity with the showing of the drawing but may be changed or modified so long as such changes or modifications mark no material departure from the salient features of the invention as expressed in the appended claims.

DETAILED DESCRIPTION OF THE PREFERRED EMBODIMENT

Figure 1:
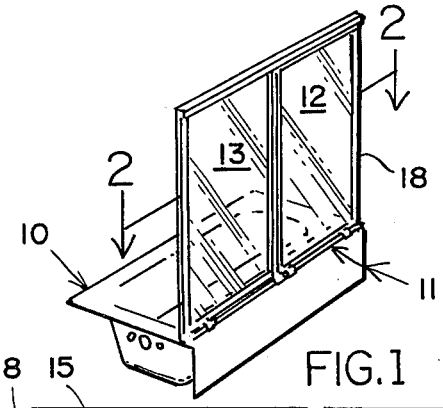
FIG. 1 is a perspective view of a tub and tub enclosure on which my panel guides are mounted.
Figure 4:
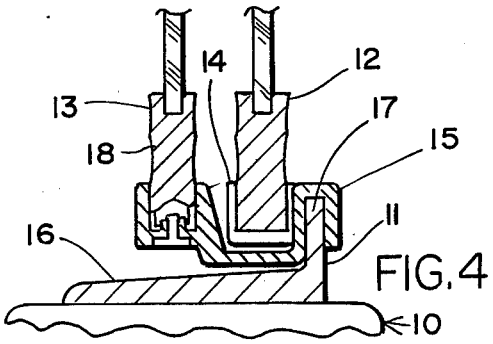
FIG. 4 is a cross sectional view taken along the line 4—4 of FIG. 3.
Figure 2:
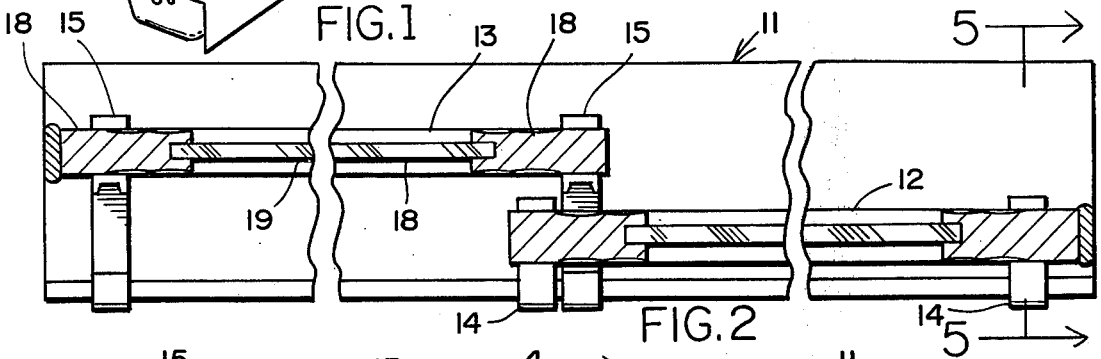
FIG. 2 is a cross sectional view taken along the line 2—2 of FIG. 1 with the panels shown in an extended position on the track.
Figure 3:
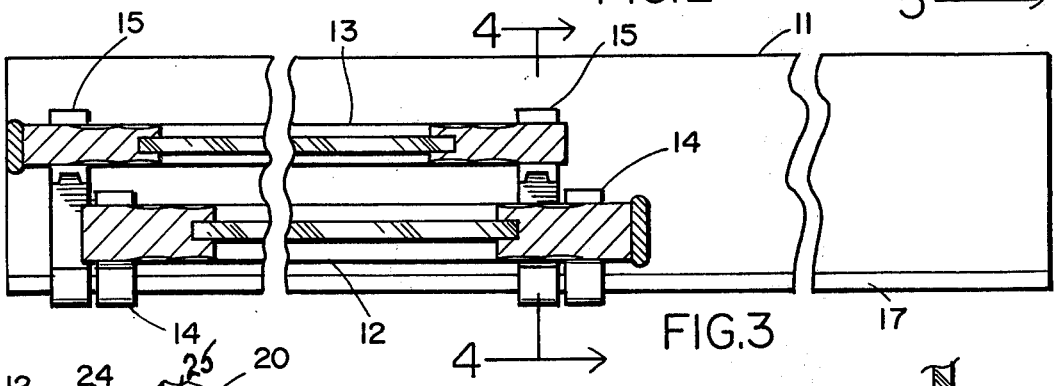
FIG. 3 is a similar view showing the panels in a retracted position.
Figure 6:
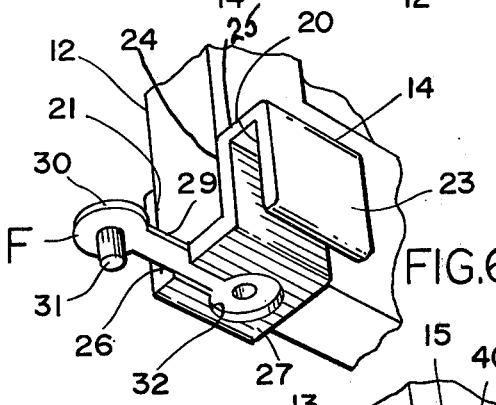
FIGS. 6 and 7 are fragmentary perspective views of panel guides shown prior to their attachment to the panels.
Figure 5:
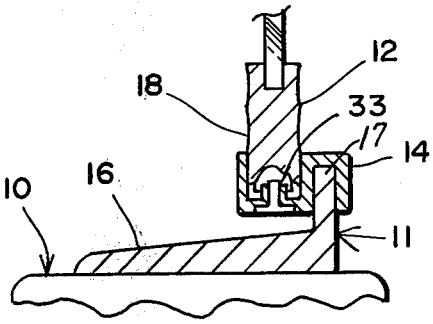
FIG. 5 is a cross sectional view taken along the line 5—5 of FIG. 2.
Figure 7:
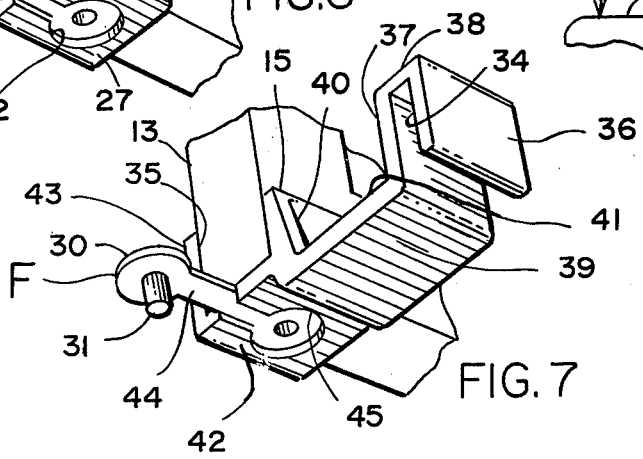

Referring to the drawings wherein like numerals are used to designate similar parts throughout the several views, the numeral 10 refers to a tub on whose top forward edge there is mounted a track 11 along which a pair of panels 12 and 13 are slidably positioned. The panels 12 and 13 are provided with a plurality of guides 14 and 15 attached thereto respectively and slidably mounted on the track 11. As explained in detail, the guides 14 and 15 are attached to the panel structures 12 and 13 and slidably mounted on the track 11.

The track 11 consists of an L-shaped member having a base portion whose upper surface 16 is slanted downwardly for draining water back into the tub 10 and an upwardly extending ledge portion 17. The ledge 17 forms the supporting structure for the panel guide members 14 and 15.

The panels 12 and 13 are conventional in construction consisting of a U-shaped frame 18 extending about a glass pane 19. The panels 12 and 13 are hung on a header (not shown) in the conventional manner by rollers to permit the easy sliding movement of the panels 12 and 13 along the outer edge portion of the tub 10. Each of the bottom frame members 18 of the panels 12 and 13 is provided with a pair of attached guide members 14 and 15 respectively, that are slidably positioned over the leg portion 17 of the track 11. The guide member 14 made of preferably molded plastic consists of an —S— cross sectional shape having two slotted portions 20 and 21. The downwardly extending slotted portion 20 which receives the ledge 17 of the track 11 consists of a pair of leg portions 23 and 24 extending in spaced and parallel relation with a web portion 25 joining the upper edge portion of the leg portions 23 and 24. The slotted portion 21 which extends upwardly to receive the frame 18 of the panel 12 is formed by a leg portion 26 joined by a web portion 27 to the leg portion 24. Extending outwardly of the web portion 27 is a tab portion 29 to which is attached a fastening member F consisting of a head portion 30 and a pin portion 31. A counter-sunk opening 32 is formed in the web portion 27 for receiving the fastener F when the tab portion 29 is folded on itself at the edge of the web portion 27 and the fastener F inserted into the opening 32. A further opening 33 is formed in the frame 18 in alignment with the countersunk opening 32 for receiving the pin 31 to thereby secure the guide member 14 to the panel 12. With the panel 12 provided with a pair of attached guide members 14 adjacent the outer edges of the panel 12 as described above and the slotted portion 20 slidably mounted over the upright ledge 17 of the track 11, the panel 12 will slide readily from one side to the other of the tub 11.

The inside panel 13 is likewise provided with a pair of attached molded guide members 15 consisting of a plurality of slotted portions 34, 35 and 41. The upwardly extending slotted portion 35 which receives the panel 13 consists of leg portions 43 and 40 joined at their lower edge portion by a web portion 42. The lower edge portion of the leg 40 is joined by a web portion 39 that extends to a vertically disposed leg portion 37 to form the slotted portion 41 and the leg portion 40 is joined at its upper edge by a web portion 38 that extends to a leg portion 36 to form the downwardly extending slotted portion 34 that receives the track 17. Extending along a side edge of the web portion 42 is a tab 44 to the end portion of which is attached a fastener F. The fastener F is provided with a head 30 and pin 31 whereby upon bending the tab portion 44, the head 30 and pin 31 are inserted into a countersunk opening 45 in the web portion 42. The pin 31 is received in an opening 46 formed in the frame 18 in alignment with the opening 45 to fasten the guide member 15 to the panel 13. The width of the web portion 39 is such that the panel 13 is maintained a sufficient distance from the ledge 17 to permit the panel 12 to slide along the ledge 17 without engaging the panel 13.

It is to be noted that the panels 12 and 13 are conventionally supported at their upper edge portions by rollers mounted on tracks in the header (not shown) so that the panels are normally suspended in close proximity to the track 11 which functions as a water drain as well as a guide for the sliding panels. However, since there are no obstructing parts such as guide members on the base surface 16, the water impinging on the panels 12 and 13 will drain off the track guide 16, 17 and into the tub 10. It is obvious, that the base portion 16 and ledge 17 are readily cleaned since water, soap, etc., cannot collect on the unobstructed smooth and inclined surface of the combined track and water return member 11.

What I claim as new and desire to secure by Letters Patent is:

1. A panel guide member for tub and shower enclosures and the like comprising a first web portion, a first leg portion extending from one edge of said first web portion, leg means extending from the other edge of said first web portion in substantially spaced relation to form a slot for receiving a panel, a second web portion extending from said leg means in substantially parallel relation with said first web portion, a second leg portion extending from said second web portion in a substantially parallel and opposite direction of said first leg portion and forming a slot with said leg means for receiving a track, a substantially pliable tab member extending from said first web portion, a pin mounted on the free end of said tab member and an opening in said first web portion for receiving said pin whereby said panel guide member is secured to said panel received in said first named slot.

2. The structure as recited by claim 1 wherein said leg means comprises a third leg portion and a third web portion, a fourth leg portion connecting said second web portion and said third web portion forming said track receiving slot and said third web portion connecting said third leg portion and said fourth leg portion to form a second panel receiving slot.

3. The structure as recited by claim 1 taken in combination with a slidable panel member, track means having a substantially flat and inclined base portion and a ledge portion, said fastening means securing said panel in said first named slot and said ledge positioned in said track receiving slot.

4. The structure as recited by claim 2 taken in combination with a slidable panel member, track means having a substantially flat and inclined base portion and a ledge portion, said fastening means securing said panel in said first named slot and said ledge positioned in said track receiving slot.

* * * * *